United States Patent [19]

Traise

[11] 4,137,528

[45] Jan. 30, 1979

[54] FAULTY WINDOW CONSTRUCTION DETECTING APPARATUS

[75] Inventor: John E. Traise, Niagara Falls, N.Y.

[73] Assignee: Moore Business Forms, Inc., Niagara Falls, N.Y.

[21] Appl. No.: 827,479

[22] Filed: Aug. 25, 1977

[51] Int. Cl.[2] ..... G08B 19/00

[52] U.S. Cl. ..... 340/675; 83/911; 93/61 AC

[58] Field of Search ..... 340/675, 600; 83/911, 83/73, 63, DIG. 1; 93/61 AC, 61 A

[56] References Cited

U.S. PATENT DOCUMENTS

| | | | |
|---|---|---|---|
| 3,420,149 | 1/1969 | Middleditch et al. | 93/93 |
| 3,553,041 | 1/1971 | von Hofe | 156/378 |
| 3,683,757 | 8/1972 | Lenk | 93/61 AC |
| 3,752,026 | 8/1973 | O'Neill | 83/911 |
| 3,833,816 | 9/1974 | Emura et al. | 340/675 |
| 3,869,965 | 3/1975 | Howatt | 93/61 A |
| 3,890,221 | 6/1975 | Muehlethaler | 209/111.7 |
| 3,917,142 | 11/1975 | Guarderas | 340/675 |
| 3,982,472 | 9/1976 | Howatt | 93/61 A |

FOREIGN PATENT DOCUMENTS 884482 12/1961 United Kingdom.

*Primary Examiner*—Glen R. Swann, III

*Attorney, Agent, or Firm*—Allegretti, Newitt, Witcoff & McAndrews

[57] ABSTRACT

A tri-level output sensor senses faulty window construction in a web of continuous business forms of stationery, for controlling visual and audible indicators, including a display of the relative position of the faulty sensed window construction, within a continually fanfolding end stack. Pulsing circuitry drives tri-level-to-digital processing circuitry, conjointly providing referencing information to process the sensor output and timing information to sample the processing circuitry, and drives a pair of counters for fanfold position indication and consecutive-fault-occurrence determination, dependent on the processing output.

12 Claims, 3 Drawing Figures

FAULTY WINDOW CONSTRUCTION DETECTING APPARATUS

BACKGROUND OF THE INVENTION

1. Field of the Invention

The invention relates to fault detection in paper sheet or web processing systems and more particularly to detection of faulty window construction in such systems.

2. Description of the Prior Art

In envelope making machines, and the like, of the type in which a continous web of patterned documents, called foldover self-mailers, is transported between a plurality of work stations, faults may arise during the die-cutting of a window opening in each pattern and during the securement of a transparent patch overlay atop the window opening. Such faults may occur in the form of hanging die-cuts where improper cutting results in paper blockage covering the window opening, or in the form of a missing window patch which leaves a naked opening in the envelope.

When these operations are performed at high speeds typical of those used in a web-offset printing press, it is very difficult to visually detect such faults in the web. Additionally, these faults are generally undesirable in any computer printing system, but where the media may include confidential information, such as pre-numbered checks, a missing window overlay is usually intolerable. Thus, it is desirable to provide a visual or audible relay of information which will signal the machine operator that a system fault has occurred.

Furthermore, where a multiple succession of such faults occur indicative of a machine jam, patch depletion, adhesive depletion or a die shoe worn to a point where it is no longer cutting properly, it is desirable to effectuate press slow-down in addition to the audible operator indication of fault occurrence. A press slow-down would prevent excessive waste of materials and guard against a more serious equipment failure. By automatically shifting the press to slow-run the operator has time to stop the press in an orderly fashion.

A desirable solution to this problem is to utilize a high speed detector for actuating controlling circuitry which operates fault occurrence indicators and which additionally may effectuate press slow down if a sequential predetermined number of consecutive faults arise.

SUMMARY OF THE INVENTION

It is therefore an object of the present invention to provide a fault detector system which will detect a hanging die-cut or a missing window patch.

It is another object of the present invention to signal the machine operator of said fault occurrence.

It is another object of the present invention to display to the machine operator which one of two types of faults has occurred.

It is another object of the present invention to indicate a visual counter position of the faulty envelope within a continuously zig-zag folded end stack.

It is another object of the present invention to determine the occurrence of a predetermined number of consecutive fault occurrences.

It is still another object of the present invention to shift the machine to a slower operating speed upon the occurrence of said predetermined number of consecutive fault occurrences.

It is another object of the present invention to devise electrical control circuitry capable of solid state fabrication using electronic logic and computing circuitry.

These and other objects of the present invention are achieved by sensing the intensity level of light passing through the window area of the web and transducing the level to a voltage waveform magnitude dependent upon the type of fault present. The voltage waveform actuates circuitry components for signaling fault occurrence to the machine operator.

A visual displayed counting mechanism may be included to count the number of successive documents or windows moving downstream after a fault has been sensed, for displaying to the machine operator the relative position of the faulty document or window within the web.

An internal counting mechanism may be included to count consecutive fault occurrences for actuating desired functional devices to effectuate machine slowdown.

DESCRIPTION OF THE PREFERRED EMBODIMENT

Figure 1:
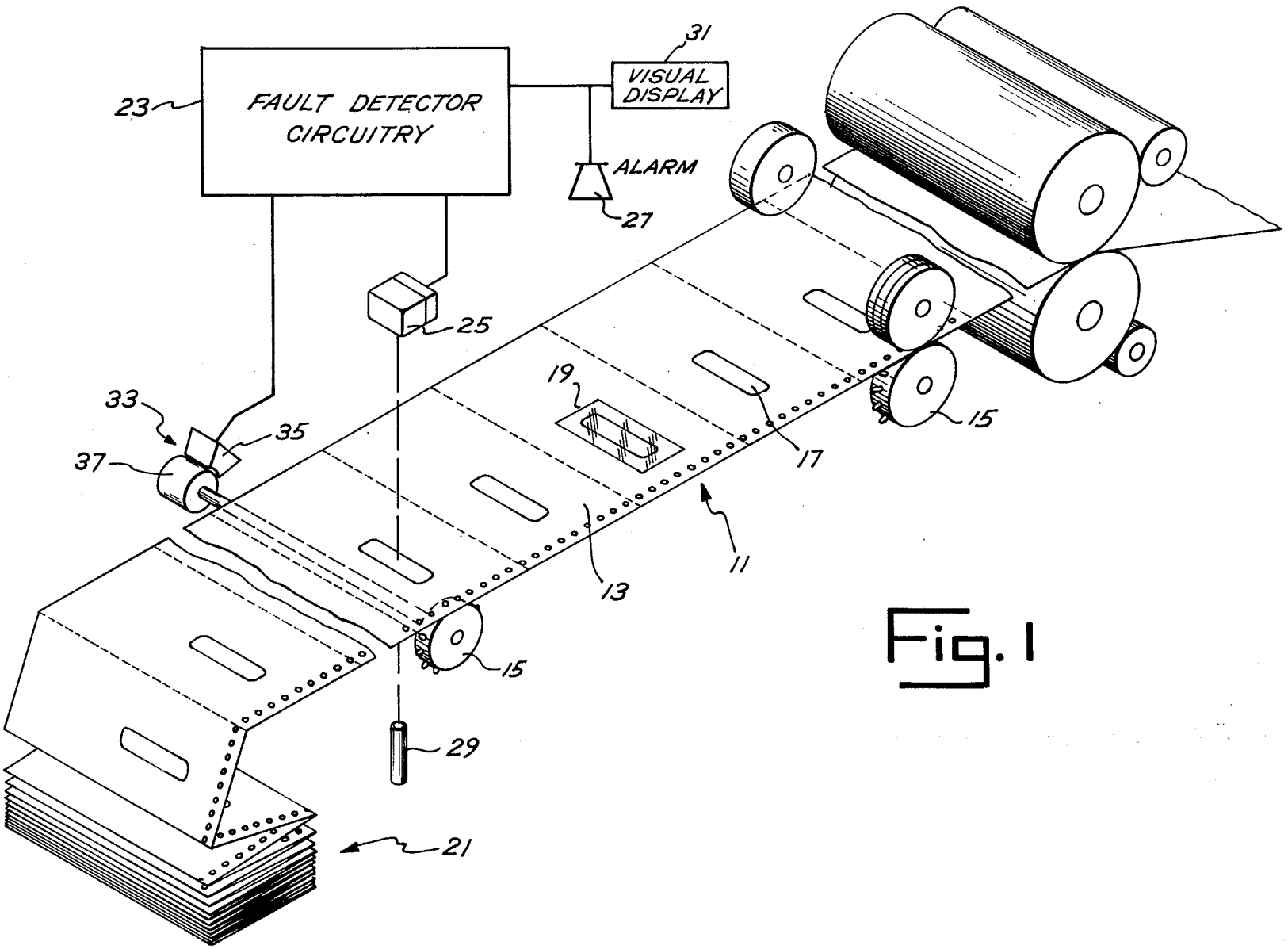
FIG. 1 is a partial perspective and partial block diagram illustration of a preferred form of a continuous web processing mechanism which could be made in accordance with a preferred form of the present invention.

As illustrated in FIG. 1, the web processing machine made in accordance with the present invention transports a continuous paper web 11 to produce a continum of identical interconnected documents 13 which may be printed and marginally punched by conventional means not shown. Additionally, the paper web is transported between a plurality of work stations, including a die-cut station (not shown) for cutting a single window opening 17 in each of the patterns 13. At a second station (not shown) each document receives a translucent paper window patch 19 which is glued or otherwise secured in place overlaying the window 17. The web is zig-zag folded at a final work station 21 with each fold in the web containing one or more of document patterns 13. (FIG. 1 illustrates a single document in each fold, but typically configurations may contain 1, 2, 3 or 4 documents on each fold face).

During operation at the work stations involving the window cutting procedure and the window patch application procedure, system faults may occur. One type of fault occurs where a window opening is not completely cut free from the paper web and a patch of paper remains at the window position. A second fault arises where the translucent paper overlay is not properly secured over the window and a naked opening is left at the window position.

To check for such faults, fault detector circuitry 23 monitors each window opening in the web via a photo transducer 25 which receives light rays from a source 29 positioned web-side opposite the transducer 25. The intensity of light received by the transducer 25 is utilized as the sensing factor in determining the presence of faults. The sensing by transducer 25 of a naked window opening results in a high intensity level received from the source 29; whereas the sensing of a paper blockage over the window 17 results in transducer 25 receiving a very low intensity level, if any, from source 29. However, with a window patch properly placed over the window, a medium intensity level lying between the high and low level will be sensed by the transducer 25.

Thus, the three intensity levels received by the transducer 25 are according to the differing levels of transmissivity of light through unimpeded clear air, through the opague web or through the translucent patch overlay.

The fault detector circuitry 23 discriminates between the tri-levels of sensing of transducer 25 and actuates an alarm 27 and visual display 31, as described hereinafter with reference to FIG. 2.

FIG. 1 also illustrates a window position indicator 33 which includes a transducer 35 cooperating with an information bearing roller 37 turning in synchronism with a sprocket wheel 15 as shown, or a shaft synchronously coupled to the machine drive. The roller 37 carries information to signal the time of the window 17 interposing the transducer 25 and source 29. The information carried by roller 37 may be magnetic, photoelectric, or the like, and further, the position indicator 33 may include other well known devices in the art for transmitting a timed voltage waveform as described hereinafter with reference to FIG. 3.

Figure 2:
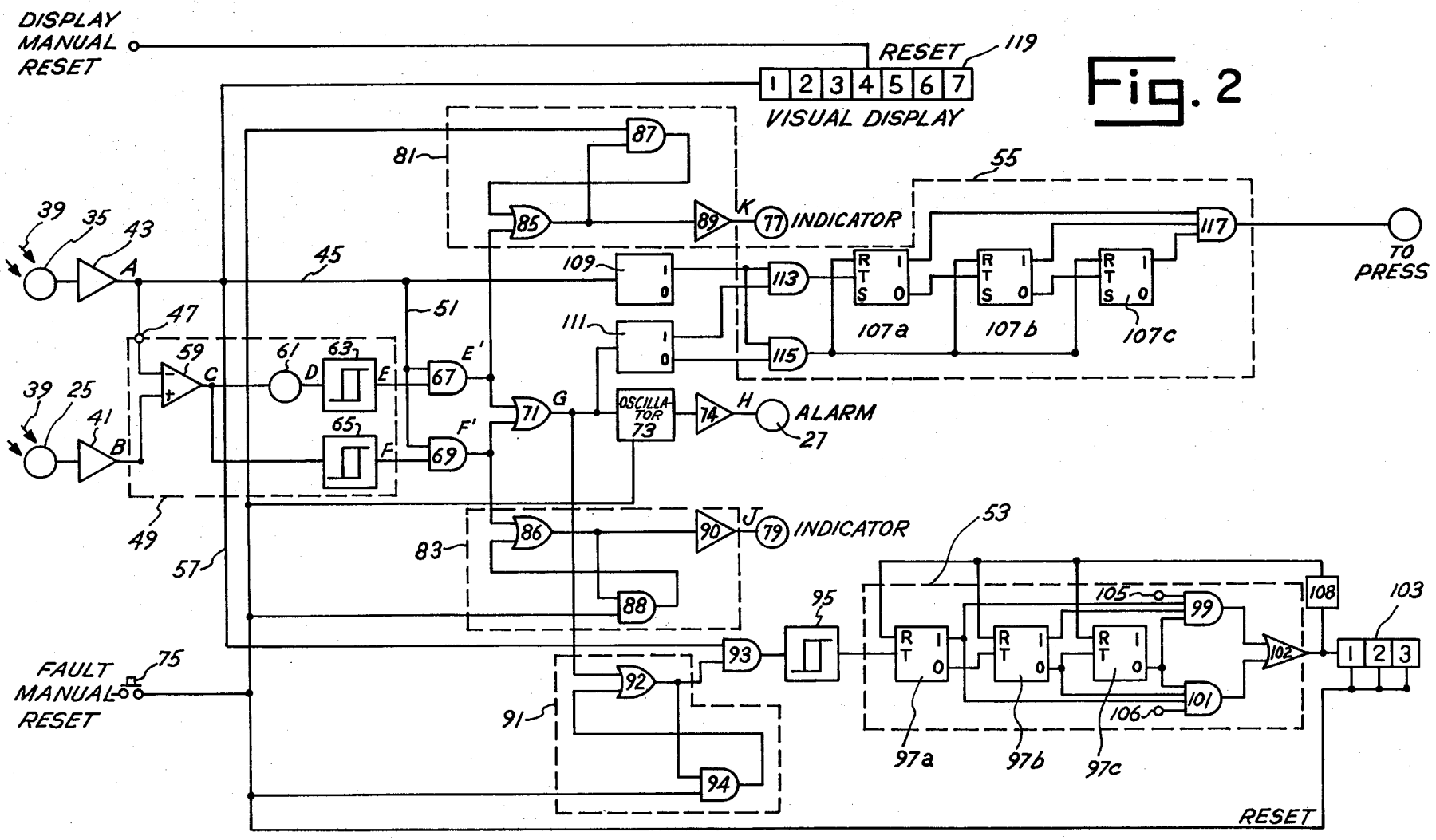
FIG. 2 is a logic circuitry diagram of fault detector circuitry made in accordance with the present invention.

The fault detector circuitry 23, as shown in more detail in FIG. 2 diagrammatically illustrates the transducers 25, 35 of FIG. 1 as receiving information 39. Each of the transducers 25, 35 produces a voltage output level amplified by amplifiers 41, 43 producing respective output waveforms B, A as illustrated in FIG. 3.

Figure 3:
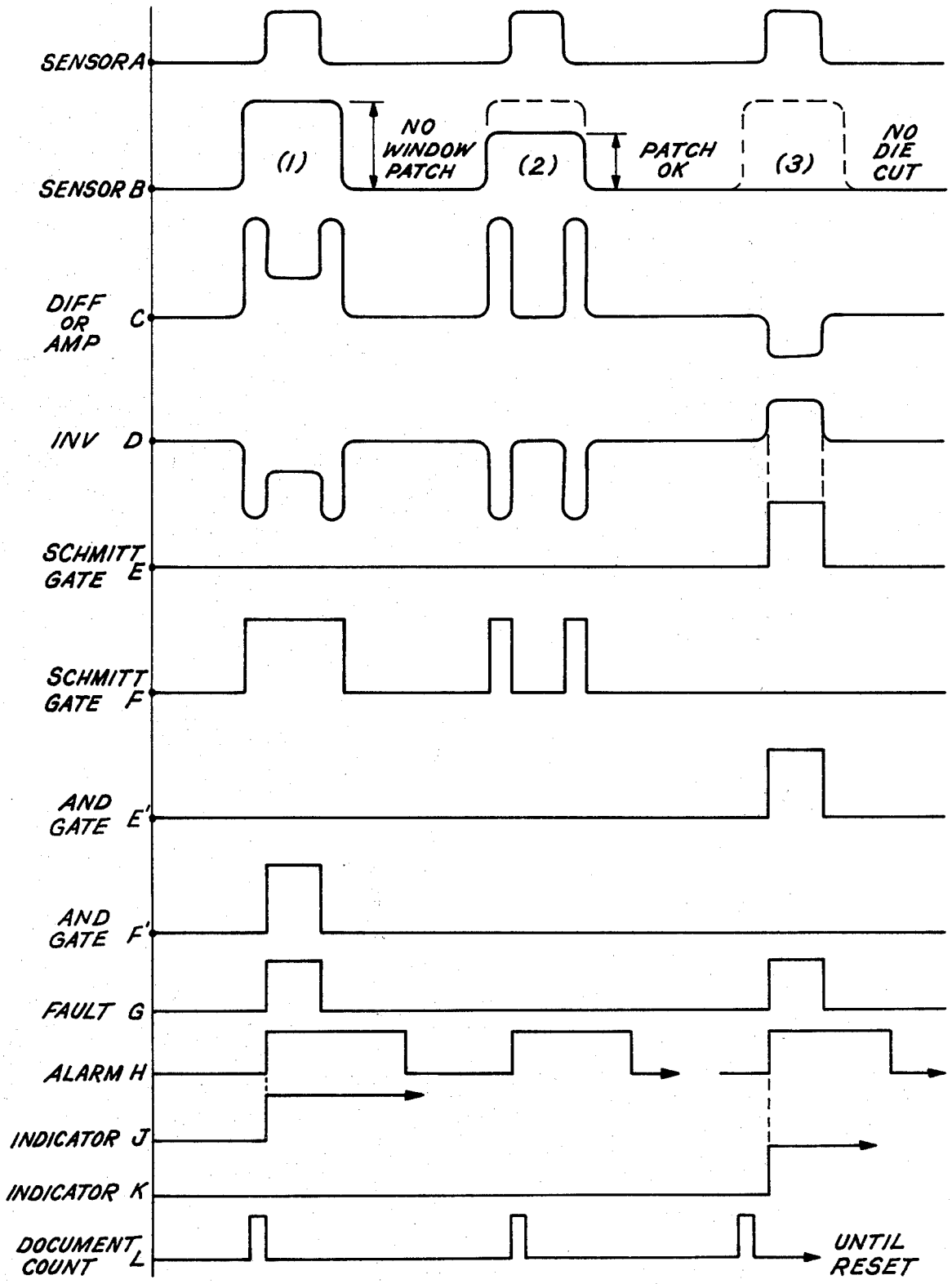
FIGS. 3A–3F, 3E', 3F', 3G, 3H, and 3J–3L are waveform diagrams of electrical voltage signals of the detector circuitry of FIG. 2, and of the logic levels produced by the circuitry in succeeding logic stages.

The output waveform A of FIG. 3 comprises a train of pulses with individual pulses occurring at the time of window interposition during monitoring of the window area by the phototransducer 25. Each pulse of waveform A is fed along drive line 45 (FIG. 2) for commanding three separate functions in the fault detector circuitry 23.

A pulse from line 45 is inputted at node 47 of tri-level scanning data processing circuitry 49 which scans the tri-level input of phototransducer 25. The line 45 provides information to be processed by the circuitry 49 in conjunction with the information of waveform B of photo transducer 25.

Also, the pulse from line 45 serves as a gating pulse along line 51 for sampling the digital outputs of tri-level scanning data processing circuitry 49.

Also, the pulse from line 45 is utilized to drive a pair of counters 53, 55 along lines 57, 45 respectively.

Referring to FIG. 3, waveform B is illustrated showing three possible functional outputs of the photo transducer 23. Where no window patch has been secured to the envelope opening and a naked opening exists, waveform (1) is produced by the phototransducer 25 as a pulse output of a first voltage magnitude. Where the window patch is properly secured over the window opening, transducer 25 will produce an output of waveform (2) as a pulse output of a voltage magnitude less than the magnitude of waveform (1). When no die-cut has occured and paper still remains at the window area, the photo transducer 25 produces an output waveform (3) having relatively zero magnitude, i.e., phototransducer 25 will not discriminate between the paper web and the paper blockage covering the position of the window opening.

The width of waveforms (1), (2), represents sensing of the entire window opening and is therefore dependent upon the size of the opening and the speed of the paper web 11. Phrased otherwise, the width depends on the transistory length of the window opening as a fractional part of the cycle repeat length between sequentially disposed openings of the paper web 11. The output pulse of wave form A is established at a smaller width than the pulse outputs of waveform B in order to cleanly sample a center portion of the document opening. The pulse of wave-form A is established at a width corresponding to the phototransducer 35 signaling a relatively narrow band force and aft of the centerline of the window position.

Referring to FIG. 2, the voltages depicted as waveforms A, B are conjointly fed to a differential operational amplifier 59 of the processing circuitry 49. The output voltage of waveform A is established at a voltage magnitude substantially equal to the magnitude of waveform (2) for providing comparison referencing information to processing circuitry 49. The differential amplifier 59 produces an output voltage as waveform C, as illustrated in FIG. 3, which is the differential of the voltages of the waveforms A and B.

Where waveform (2) is produced by the phototransducer 25 indicating that the system is sampling a correctly affixed window patch, the voltage level of waveform A will be subtracted from the voltage level of waveform B through the differential amplifier 59 to produce a low output of waveform C during the time of pulsing of phototransducer 35. Because of fluctuations in light intensity passed through the patch overlay, this low voltage output of waveform C may vary in magnitude, however, the threshold-type operation of Schmitt gates 63, 65, described hereinafter, permit fluctuations in light transmissivity of the patch overlay 19.

Where waveform (3) is produced by the phototransducer 25 indicating lack of die-cut occurrence, the differential amplifier 59 will produce a substantial negative-going voltage pulse as illustrated in waveform C. The negative-going voltage pulse of waveform C is fed from differential amplifier 59 to inverter 61 producing a positive-going pulse as illustrated in waveform D of FIG. 3. The positive-going pulse of waveform D actuates Schmitt gate 63 producing a logical "1" valued pulse for reception by the digital control of the remainder of circuitry 23. Thus, inverter 61 and Schmitt gate 63 process waveform C to produce a digital waveform of logical value "1" whenever waveform (3) is produced by phototransducer 25 (see waveform E of FIG. 3).

The waveform C is fed also to a Schmitt gate 65 for producing an output digital-valued waveform F of FIG. 3. The Schmitt gate 65 produces a logical "1" output so long as the input waveform C retains a substantial positive magnitude level. Thus, Schmitt gate 65 eliminates the negative-going pulse of the waveform C and produces a logical "1" output during the pulse time of waveform A whenever the waveform (1) occurs.

The processing circuitry 49 thus produces two logical valued waveform outputs E, F, according to the processing of waveform B referenced against the information carried by waveform A. Thus the processing circuitry 49 converts the tri-level input from transducer 25 to a digital output waveform.

The pulses of waveform A are fed along line 51 to sample the output of the processing circuitry 49. Waveform E is sampled by the pulse from waveform A via AND gate 67 for producing waveform E'. Whenever waveform E' is a logical "1" value, a fault has occurred and therefore, appropriate indications should be initiated to the machine operator.

Similarly, the pulse of waveform A is fed along line 51 to sample the output waveform F of the processing circuitry 49 via AND gate 69 to produce a waveform output F'. The waveform output F' is at a logical "1" value whenever the waveform (1) has been produced by the phototransducer 25.

Thus, the processing circuitry 49 converts a tri-level input from transducer 25 to a digital output of waveform (E', F'), where (E', F') = 01, signifies waveform (1); (E', F') = 00, signified waveform (2); and (E', F') = 10, signifies waveform (3).

Both logical output waveforms E' and F' are fed to an OR gate 71 to provide an output waveform G which will produce a logical one output whenever photo transducer 25 indicates that a fault has occurred in the system. The waveform G is utilized to drive the alarm 27 and to initiate counting by the counters 53, 55.

A logical one output of the OR gate 71 triggers an oscillator 73 to drive alarm 27 through an amplifier 74. The oscillator 73 may produce, for example, a one-second-on/one-second-off signal. The alarm remains actuated until the oscillator 73 is reset via a manual reset button 75 which is positioned on the machine for operator actuation. The output of the oscillator 73 is illustrated by the continuous waveform H of FIG. 3.

Visual display indicators 77, 79 may be positioned for operator viewing for indicating which type of fault has occurred. The indicators 77, 79 are driven by respective waveforms E', F', actuating latching circuitries 81, 83 for producing respective outputs K, J. The latching circuitries 81, 83 include OR gates 85, 86 and AND gates 87, 88 which serve to latch a logical "1" output to amplifiers 89, 90 driving indicators 77, 79. The latching circuitries are reset by the manual reset button 75.

The drive pulses along the line 45 also serve to trigger counter 53 for counting the number of fan folds at document station 21 to indicate which fold contains the sensed faulty window. The waveform G is fed to a latching circuitry 91 comprised of OR gate 92 and AND gate 94, for latching AND gate 93 to pass a logical "1" output according to each subsequently sensed document as indicated by drive pulses along line 45. Schmidt gate 95 reshapes the output of the AND gate 93 to discrete pulses as illustrated in wave form L of FIG. 3. Each pulse of waveform L toggles the counter 53.

Counter 53 is illustrated as including three flip-flops *97a, 97b, 97c* producing a recirculating count of a binary seven. The output of the three flip-flops *97a–97c* are sampled by AND gates 99, 101 to produce a counting pulse output to visual counter and decimal display 103 via OR gate 102. The output from OR gate 102 is fed back to reset the flip-flops *97a–97c* via delay element 108. The AND gates 99, 101 are selectively actuable at inputs 105, 106 for changing the recirculative count of the counter 53 to a count of 6 or 4 respectively. The nodes 105, 106 are selectively actuated depending upon the number of envelopes in each separate fold, such that the display 103 counts and registers the relative fold position at work station 21 where the faulty document is located.

The counter 53 may be manually reset via reset button 75 which serves to extinguish the latching circuitry 91 and resets the visual display 103. Each of the flip-flops *97a–97c* of the counter 53 may similarly be reset by the manual reset button 75.

A counter 55 is also included in the circuitry 23, comprised of three flip-flops *107a, 107b, 107c* for counting consecutive faults which occur. An occurrence of eight consecutive faults will produce a signal from AND gate 117 to initiate slow down of the envelope press and begin running the press at a slower speed.

The waveform pulse along line 45 actuates a flip-flop 109 to produce a logical "1" output during each pulsing of line 45. The waveform G is fed to a flip-flop circuitry 111 which produces a (1, 0) output, as shown, whenever waveform G is at a logic "1" level. As waveform G goes to a logic "0" level, the flip-flop 111 reverses its outputs to (0, 1).

Thus, whenever the line 45 and the waveform G are high, the counter is pulsed via AND gate 113. Whenever a high output appears on line 45 without a corresponding logical "1" output from waveform G, the counter 55 is reset via AND gate 115. Thus, the counter 55 only counts the occurrence of consecutive faults and serves to signal when a particular quantity of consecutive faults has occurred via AND gate 117.

The pulses along line 45 may be utilized to serve other functions as for example triggering a visual display 119 for indicating the number of envelopes that the machine has processed at any given moment.

It should be understood, of course, that the foregoing disclosure relates to a preferred embodiment of the invention and that other modifications or alterations may be made therein without departing from the spirit or scope of the invention as set forth in the appended claims.

What is claimed is:

1. In a high speed press comprising a die-cut system for successively cutting window openings in a plurality of window areas of a moving web and comprising a window patch securement system for securing a window patch over each window opening, fault detector circuitry for signaling the presence of light-blocking material covering a window area and for signaling the absence of a window patch which leaves an opening in a window area, comprising:

phototransducer means positioned to sense the transparency of the web along the line of window travel for transducing a sensed opening in a window area to a first output level, transducing sensed light-blocking material to a second output level and transducing a sensed window patch overlaying a window opening to a third output level;

referencing means for producing a predetermined output level at the time a window area is in a position to be sensed by said phototransducer means;

processing circuitry means receiving the output of said referencing means and the output of said phototransducer means for producing a fault signal indicative of the sensing of light-blocking material in a window area or a window opening; and operator indicator means responsive to said fault signal for providing an operator indication of the occurrence of a fault.

2. In a high speed press comprising a die-cut system for successively cutting window openings in a plurality of window areas of a moving web and comprising a window patch securement system for securing a window patch over each window opening, a fault detector circuitry for signaling the presence of light-blocking material covering a window area and for signaling the absence of a window patch which leaves an opening in a window area, comprising:

phototransducer means positioned to sense the transparency of the web along the line of window travel for transducing a sensed opening in a window area to a first output level, transducing a sensed light-blocking material to a second output level and transducing a sensed window patch overlaying a window opening to a third output level;

trivalue-to-binary conversion means receiving the output of said phototransducer means for converting said first, second and third output levels to binary output signals; and operator indicator means responsive to said binary output signals for providing an operator indication of a machine fault.

3. Apparatus according to claim 2 and further comprising referencing means for producing a predetermined output level at the time when a window area is in position to be sensed by said phototransducer means; and wherein said conversion means uses the predetermined output level for discriminating between said first, said second and said third output levels in order to generate the binary output signals.

4. Apparatus according to claim 3 wherein said conversion means comprises means for producing a difference output representing the difference in amplitude between the predetermined output level and the instantaneous output level of the phototransducer means.

5. In a high speed press comprising a die-cut system for successively cutting window openings in a plurality of window areas in a moving web and comprising a window patch securement system for securing a window patch over each window opening, fault detector circuitry for signaling the presence of light-blocking material covering a window area and for signaling the absence of a window patch which leaves an opening in a window area, comprising:

phototransducer means positioned for sensing the transparency of the web along a line of travel of the windows for producing an output including a first voltage level output when sensing an opening in a window area, producing a second voltage level output when sensing light-blocking material and producing a third voltage level output when sensing a window patch overlaying a window;

pulse timing means for producing an output including a driving pulse each time when a window should be in a position to be sensed by the phototransducer means;

processing circuitry means receiving the output of said phototransducer means and actuable by said driving pulses for producing an output indicative of the sensing of a window opening or the sensing of light-blocking material in a window area; and counter means actuable by the output of said processing circuitry means for counting in response to said driving pulses.

6. Apparatus according to claim 5, wherein each of said driving pulses has said third voltage level output; wherein processing circuitry means receives said driving pulses as an input; and wherein said processing circuitry means includes means for comparing said driving pulses to the output of said phototransducer means.

7. Apparatus according to claim 6, wherein said means for comparing includes means for producing an output signal representing the difference between the amplitudes of the pulse timing means output and the phototransducer means output.

8. In a high speed press comprising a die-cut system for successively cutting window openings in a plurality of window areas of a moving web and comprising a window patch securement system for securing a window patch over each window opening, fault detector circuitry for signaling the presence of light-blocking material covering a window area and for signaling the absence of a window patch which leaves an opening in a window area, comprising:

phototransducer means positioned for sensing the transparency of the web along a line of travel of the windows, for producing a first voltage level output while sensing an opening in a window area, producing a second voltage level output when sensing light-blocking material and producing a third voltage level output when sensing a window patch overlaying a window opening;

processing circuitry means for converting the output of said phototransducer means to binary output signals; and pulse timing means for producing a driving pulse at the time when a window should be in a position to be sensed by the phototransducer means, said driving pulse sampling the output of the processing circuitry means for providing a fault output indicative of the sensing of light-blocking material in a window area or a window opening.

9. Apparatus according to claim 8 wherein said driving pulse is inputted to said processing circuitry means and said driving pulse has said third voltage level output for referencing said processing circuitry means.

10. In a machine for processing a plurality of self mailers arranged in a web, said machine comprising a die-cut system for successively cutting a window opening in a window area of each self mailer and further comprising a window patch securement system for securing a window patch over each window opening, fault detector circuitry for signaling the presence of light-blocking material covering a window area and for signaling the absence of a window patch which leaves an opening in a window area, comprising:

phototransducer means for sensing the transparency of the window area of each said self-mailer for transducing the sensing of light-blocking material to a first output level and transducing the sensing of an opening in a window area to a second output level;

processing means receiving the output of said phototransducer means for discriminating between the reception of a said first or a said second output level; and operator indicator means responsive to said processing means for providing an operator indication of a fault detected.

11. Apparatus according to claim 10 and further including:

counting means responsive to said processing means for initiating counting in response to the movement of successive self-mailers.

12. Apparatus according to claim 10 and further including: transducer means for sensing the relative position of the window area of successive moving self mailers with respect to said phototransducer means, said transducer means producing a drive signal output when a window area is in position for sensing by said phototransducer means; and wherein said processing means is responsive to said drive signal out-output.

* * * * *